United States Patent [19]

Yamagata

[11] Patent Number: 5,010,628

[45] Date of Patent: Apr. 30, 1991

[54] COUPLING ELEMENT ROW FOR SLIDE FASTENER AND SURFACE TREATING METHOD FOR THE SAME

[75] Inventor: Hiroshi Yamagata, Tateyama, Japan

[73] Assignee: Yoshida Kogyo K.K., Tokyo, Japan

[21] Appl. No.: 506,247

[22] Filed: Apr. 9, 1990

[30] Foreign Application Priority Data

Apr. 7, 1989 [JP] Japan ..... 1-86848

[51] Int. Cl.[5] ..... A44B 19/02

[52] U.S. Cl. ..... 24/405; 24/389

[58] Field of Search ..... 24/405, 389, 392, 296, 24/426; 428/457, 688

[56] References Cited

U.S. PATENT DOCUMENTS 3,991,230 11/1976 Dickie et al. ..... 428/458
4,113,815 9/1978 Kawamura ..... 264/101
4,485,153 11/1984 Janikowski et al. ..... 428/688
4,565,719 1/1986 Phillips et al. ..... 428/457
4,567,111 1/1986 Janikowski et al. ..... 428/457
4,604,774 8/1986 Yamaguchi et al. ..... 24/389

*Primary Examiner*—Victor N. Sakran
*Attorney, Agent, or Firm*—Hill, Van Santen, Steadman & Simpson

[57] ABSTRACT

A coupling element row for a slide fastener, comprising fine metal particles individually deposited on the etched surface of a continuous coupling element row made of a synthetic resin, and a surface treating method for preparing the coupling element row for a slide fastener comprising the steps of etching the surface of a continuous coupling element row made of a synthetic resin, and depositing fine metal particles individually on the etched surface of the continuous coupling element row by sputtering while feeding the coupling element row so as not to distort the pitch thereof.

5 Claims, 6 Drawing Sheets

COUPLING ELEMENT ROW FOR SLIDE FASTENER AND SURFACE TREATING METHOD FOR THE SAME

BACKGROUND OF THE INVENTION

1. Field of the Invention

The present invention relates to an improved continuous coupling element row, which is made of a synthetic resin, for a slide fastener, and to a surface treating method for the coupling element row.

2. Description of the Prior Art

Conventionally, a continuous coupling element row, which is made of a synthetic resin, for a slide fastener on which a metallic material is deposited for purposes of decoration is commonly known. In such a product the deposition of the metallic material is accomplished by means of a plating process. The plating process requires a large number of processing stages in each of which the coupling element row must be fed horizontally into a chemical bath for treatment. Therefore, a tension load is applied to the coupling element row along its length when it is subjected to the conventional plating process. As a result, the pitch of the coupling element row tends to be distorted and its function as a slide fastener is impaired. Throughout the specification, the term "pitch" is used to mean a "spacing between adjacent coupling elements".

In addition, the metallic material is merely deposited on the surface of the coupling element row in the form of a film, and the film itself is hard and is not flexible. Therefore, when the coupling element row is bent, the deposited metallic material is easily cracked. When the motion of the slider is added to the slide fastener having such cracks, exfoliation of the metallic film occurs over a wide range and the external appearance of the product becomes unsightly.

SUMMARY OF THE INVENTION

Accordingly, a first object of the present invention is to provide an improved continuous coupling element row for a slide fastener made of a synthetic resin, which is free from the drawbacks in the prior art.

A second object of the present invention is to provide a surface treating method for a continuous coupling element row for a slide fastener, by which metal particles can be firmly deposited on the surface of a coupling element row made of a synthetic resin without distorting the pitch thereof.

The first object of the present invention can be achieved by a coupling element row for a slide fastener, comprising fine metal particles individually deposited on the etched surface of a continuous coupling element row made of a synthetic resin.

The second object of the present invention can be attained by a surface treating method for a coupling element row for a slide fastener, comprising the steps of etching the surface of a continuous coupling element row made of a synthetic resin, and depositing fine metal particles individually on the etched surface of the continuous coupling element row by sputtering while feeding the coupling element row so as not to distort the pitch thereof.

BRIEF DESCRIPTION OF THE DRAWINGS

A more complete appreciation of the invention and many of the attendant advantages thereof will be readily obtained as the same becomes better understood with reference to the following detailed description when considered in connection with the accompanying drawings, wherein.

DETAILED DESCRIPTION OF THE PREFERRED EMBODIMENTS

Figure 1:
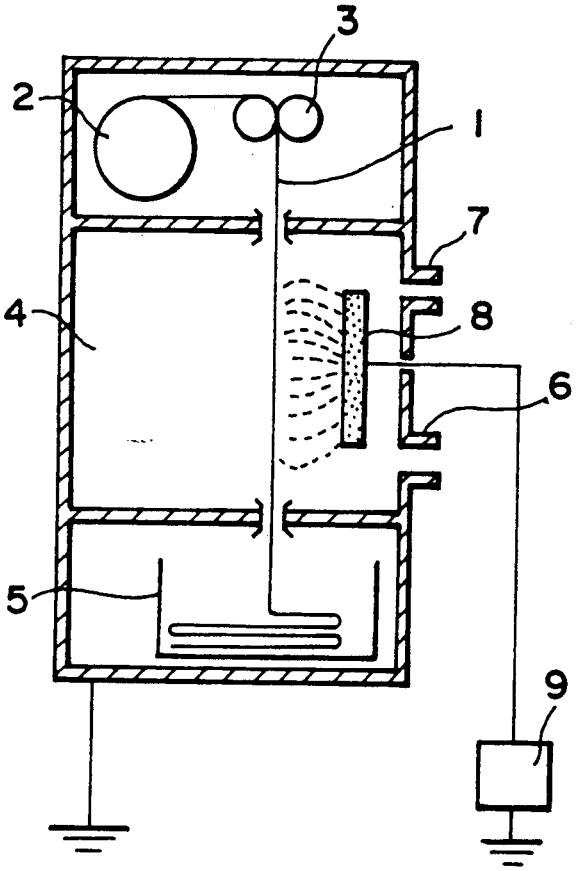
FIG. 1 is a sectional view of a device suitable for the implementation of the first embodiment of a surface treating method according to the present invention.

In the etching process of the present invention, an appropriate gas, for example, gas selected from among argon gas, oxygen gas and nitrogen gas or a mixed gas thereof is introduced into a vacuum chamber in which an anode plate and a cathode plate are arranged in parallel with the coupling element row arranged to extend parallel and between these plates. The cathode plate is connected to a high frequency power source, and a voltage is applied to the cathode plate so that a plasma is produced between the anode and cathode plates. Irradiation ions are produced in this manner. When these ions are directed onto the coupling element row, functional groups are formed on the surface of the coupling element row, or molecules on the surface of the coupling element row are locally decomposed. Thus, extremely small indentations are formed to provide an anchoring effect on the surface of the coupling element row.

A chemical method can also be used for the etching process. For example, a coupling element row made from a polyethylene terephthalate polyester resin is treated with an aqueous amine or a chromic acid mixture to roughen its surface.

A sputtering process is employed to individually deposit fine metal particles on the etched surface of the coupling element row.

In the sputtering process, argon gas is introduced into the vacuum chamber, and the coupling element rows are arranged in the chamber parallel to a target which serves as a cathode. When a voltage is applied to the target, an electric discharge occurs between the target and the coupling element rows, and an argon plasma is produced. By impinging high energy ions from within the argon plasma onto the target, the metal molecules in the target are driven out. These metal molecules deposit as fine particles on the etched surface of the coupling element row. When the sputtering is carried out while the coupling element row is being continuously fed, the fine metal particles are deposited on the coupling element row in the longitudinal direction.

In particular, if a magnetron sputtering method is implemented, it is possible to collect the plasma thermoelectrons within the magnetic field by forming a magnetic field on the surface of the target. Therefore, if the coupling element row is positioned outside the plasma, it is possible to prevent the thermoelectrons from raising the temperature of the coupling element row. For this reason, the pitch of the coupling element row or the coupling element row itself is not thermally distorted. Magnetron sputtering is thus advantageous over vacuum deposition and ion plating which tend to distort the pitch of the coupling element row or the coupling element row itself by radiant heat generated when a metallic material is fused.

When the target is made of aluminum, chromium, silver, or titanium, silver-colored metal particles are deposited on the surface of the coupling element row. In the case where the target is made of an alloy of copper and zinc, an alloy of copper and aluminum, or gold, gold-colored metal particles are deposited on the surface of the coupling element row.

The target may be made of a single metal or of an alloy. Therefore, materials with various types of metallic tone of brilliance can be deposited on the surface of the coupling element row.

It is possible to perform the etching and sputtering steps as a continuous process.

Since the fine metal particles are individually deposited on the etched surface of a continuous coupling element row made of a synthetic resin, the deposited metal particles are not hardened and provide a flexible coupling element row. In addition, the fine metal particles are deposited on the coupling element row in a manner which does not distort the pitch of the coupling element row while the coupling element row is being fed, so that the finished coupling element row is free from distortion of the pitch thereof.

Referring now to the accompanying drawings, the present invention will be explained in more detail.

FIG. 1 is a sectional view of a device suitable for the implementation of the first embodiment of the surface treating method according to the present invention. A bobbin 2 around which is wound a continuous synthetic resin coupling element row 1 whose surface had been etched in advance is housed in the upper part of the device. The coupling element row 1 is drawn out in the downward direction through a pair of feed rollers 3. A sputtering chamber 4 is provided in the center section of the device. A suitable container 5 is positioned in the lower section of the device and the coupling element rows 1 are stored in the container 5 in sequence after the sputtering process has been completed. The coupling element row 1 is fed vertically downward through the rollers 3 into the sputtering chamber 4 so that the pitch of the coupling element row 1 is not distorted.

The sputtering chamber 4 is provided with a gas discharge port 6 which is connected to a vacuum pump (omitted from the drawing). An argon gas feed port 7 through which argon gas is introduced into the chamber 4 is also provided. A target 8 is positioned parallel to the coupling element row 1 and is made of a material capable of providing metallic particles to be deposited onto the coupling element row 1. The target 8 serves as a cathode electrode and is connected to a high voltage power source 9. The device itself, which is made of a metal, can be an anode electrode.

The coupling element row 1 with the preliminarily etched surface is fed from the bobbin 2 through the feed roller 3 vertically downward into the sputter chamber 4. The sputtering chamber 4 is evacuated, into which argon gas is introduced through the argon gas feed port 7. When a voltage is applied to the target 8, an electric discharge occurs between the target 8 and the coupling element row 1, and argon plasma is produced. By impinging high energy ions in the argon plasma upon the target 8, the molecules of the metal from which the target 8 is prepared are driven out of the target 8. These metallic ions deposit on the etched surface of the coupling element row 1 in the form of fine metal particles. This deposition is conducted continuously.

The continuous coupling element row made of a synthetic resin applicable to the surface treating method according to the present invention will be explained with reference to FIG. 2*a* to FIG. 6*b*.

Figure 2A:
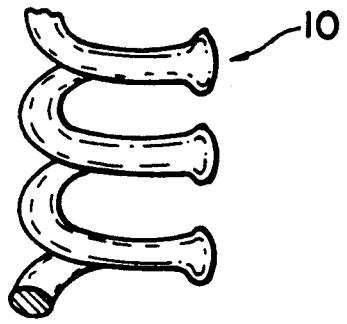
FIG. 2*a* to FIG. 6*b* are schematic illustrations of various types of coupling rows according to the present invention.

FIG. 2*a* shows a coupling element row 10 in the form of a coil.

Figure 2B:
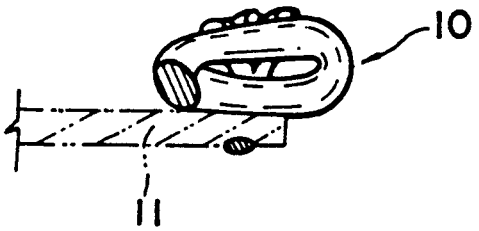
Figure 3A:
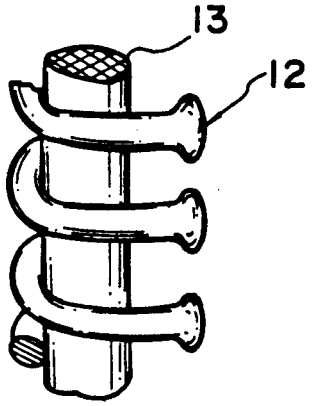
Figure 3B:
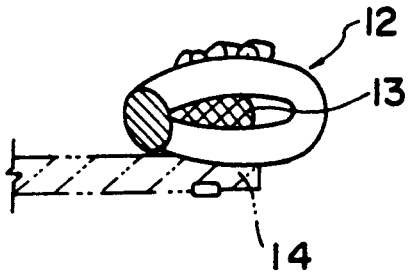
Figure 3C:
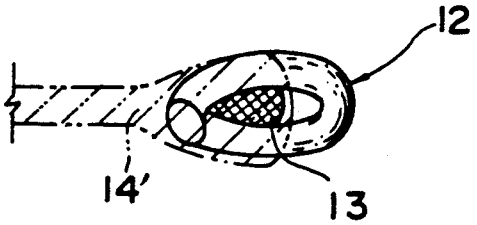

FIG. 2*b* shows the coupling element row 10 attached by a stitching thread to a support tape 11. FIG. 3*a* shows a coupling element row 12, also in the form of a coil. In this case, a core cord 13 runs through inside the coupling element row 12 in the longitudinal direction. FIG. 3*b* shows the coupling element row 12 attached by a stitching thread to a support tape 14. FIG. 3*c* shows the coupling element row 12 which is woven into the edge of a support tape 14' when the support tape is woven.

Figure 4A:
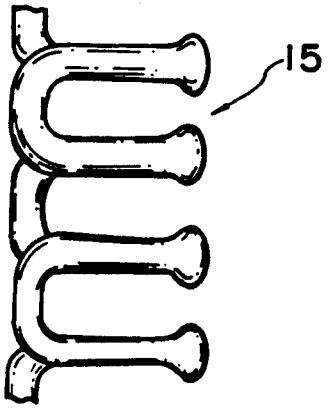
Figure 4B:
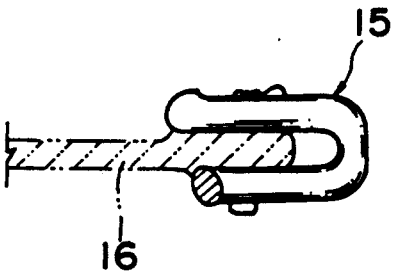
Figure 5A:
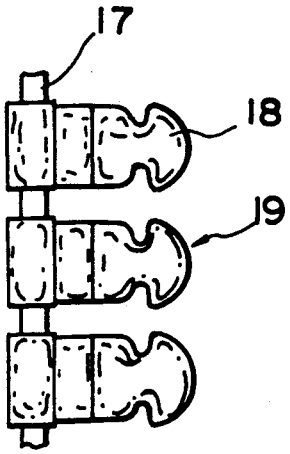
Figure 5B:
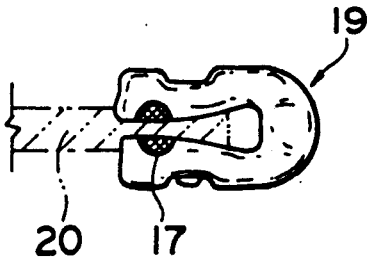
Figure 6A:
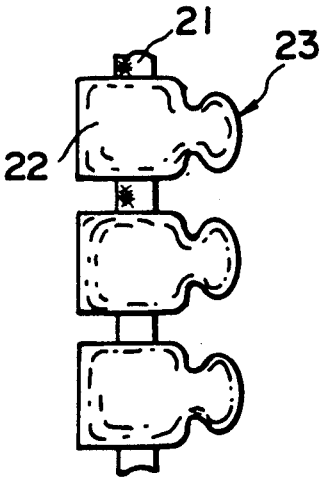
Figure 6B:
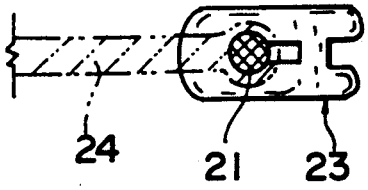

FIG. 4*a* shows a coupling element row 15 in a zigzag form. FIG. 4*b* shows the coupling element row 15 extending over the edge of a support tape 16 and attached by a stitching thread. FIG. 5*a* shows a coupling element row 19 comprising coupling elements 18 formed by an extruder in the shape of a ladder running parallel to a pair of connecting cords 17 which is separated in the longitudinal direction, with the coupling elements 18 bent into a U-shape centered around the coupling head. FIG. 5*b* shows the coupling element row 19 extending over the edge of a support tape 20 and attached by a stitching thread. FIG. 6*a* shows an coupling element row 23 comprizing coupling elements 22 formed on a connecting cord 21 by a synthetic resin injection-molding machine. As shown in FIG. 6*b*, the coupling element row is woven into the edge of a support tape 24 when the support tape is woven.

After the etching of any of these types of continuous coupling element rows made of a synthetic resin, sputtering is carried out while the coupling element row is being fed to the device shown in FIG. 1. The coupling element rows shown in FIG. 2*a* and FIG. 4*a*, in particular, are synthetic resin monofilaments formed in a coil-shape or a zigzag-shape in the longitudinal direction. Since the dimension of these coupling element rows in the longitudinal direction is unstable, the coupling element row must be fed so that its pitch is not distorted when sputtering is performed. In addition, in the coupling element rows shown in FIG. 3*a*, FIG. 5*a* and FIG. 6*a*, a core cord or connecting cord is provided, running in the longitudinal direction. The core cord or connecting cord is made from a woven material. Since this material itself expands or contracts, its longitudinal dimension is unstable. Therefore, when sputtering is carried out, the coupling element row must be fed so that the pitch of the coupling element row is not distorted.

Figure 7:
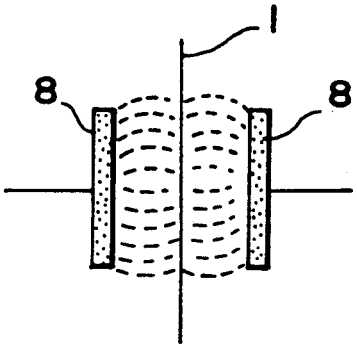
FIG. 7 and FIG. 8 are schematic illustrations showing the sputtering process in the surface treating method according to the present invention.
Figure 8:
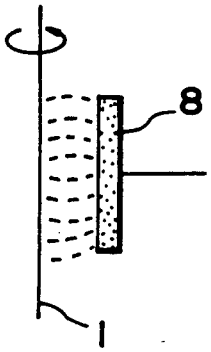

In the device shown in FIG. 1, sputtering is carried out on one side of the coupling element row only. However, when the targets 8, 8 are positioned on each side of the coupling element row as shown in FIG. 7, sputtering can be performed over both faces of the coupling element row 1 simultaneously. If the coupling element row is rotated relative to the target 8 as shown in FIG. 8, sputtering can also be performed over both faces of the coupling element row 1. In this case, not only does the sputtering extend over the both faces of the coupling element row, but the coupling heads can also be completely sputtered.

In addition, as shown in FIGS. 2a, 3a, 4a, 5a and 6a, sputtering may be performed while a single coupling element row is being fed. Sputtering may also be performed while a pair of inter-engaged coupling element rows are being fed together.

Figure 9:
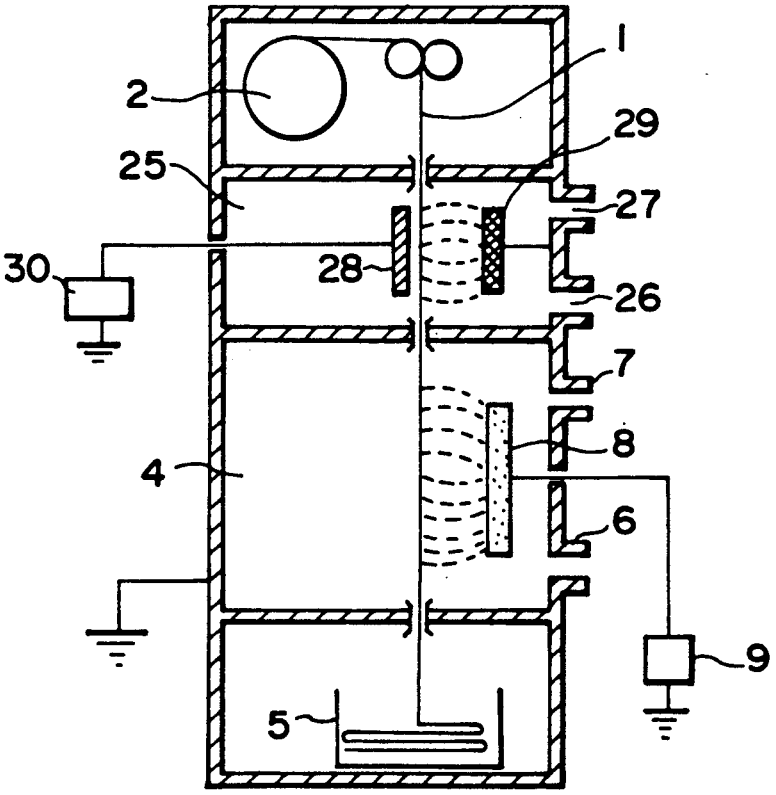
FIG. 9 is a sectional view of a device suitable for the implementation of the second embodiment of a surface treating method of the present invention.

FIG. 9 is a sectional view of a device suitable for the implementation of the second embodiment of the present invention. This device is equivalent to the embodiment of FIG. 1 with an etching chamber 25 added.

Specifically, the etching chamber 25 is provided between the sputtering chamber 4 and the upper section of the device which houses the bobbin 2. The coupling element row 1 is fed downward from the etching chamber 25 to the sputtering chamber 4 without distorting the pitch of the coupling element row 1. The etching chamber 25 is provided with an exhaust gas port 26 connected to a vacuum pump, and a gas inlet port 27 through which an appropriate gas, for example, at least one gas selected from among argon gas, oxygen gas, and nitrogen gas, is introduced into the etching chamber. A cathode plate 28 and an anode plate 29 are arranged in parallel in the chamber, and the coupling element row 1 is arranged between and parallel to these plates. The cathode plate 28 is connected to a high frequency power source 30.

When an appropriate gas as mentioned above is introduced into the etching chamber 25 through the gas inlet port 27, and a voltage is applied to the cathode plate 28, a plasma is produced between the cathode plate 28 and the anode plate 29. Irradiation ions are produced in this manner, and when these ions are directed onto the coupling element row 1, functional groups are formed on the surface of the coupling element row 1 or molecules on the surface on the coupling element row is decomposed. Thus, extremely small indentations are formed, which provide an anchoring effect by which metal particles are firmly deposited on the surface of the coupling element rows during the sputtering process.

Figure 10:
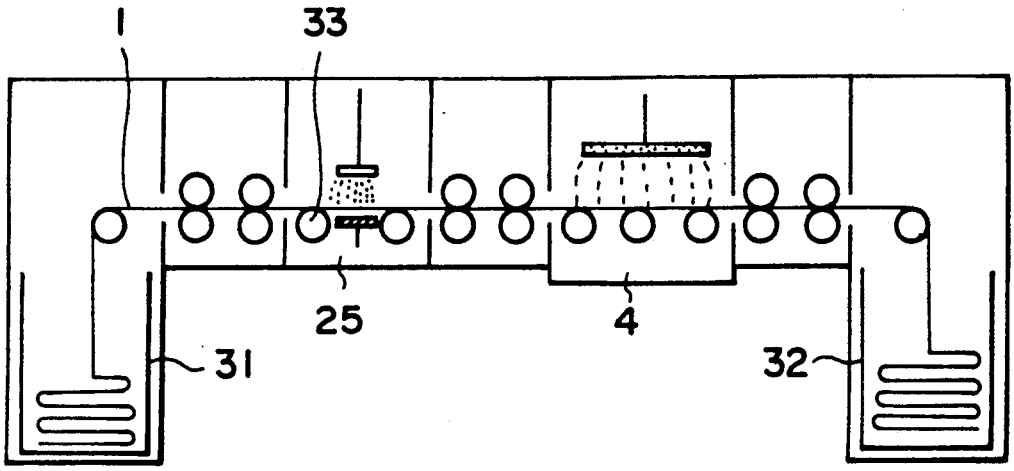
FIG. 10 to FIG. 15 are schematic illustrations showing other types of sputtering processes in the surface treating method according to the present invention.

In the foregoing embodiments of the present invention, sputtering is performed while the coupling element row is being fed in the vertical direction. However, as shown in a device suitable for the implementation of the third embodiment of the present invention illustrated in FIG. 10, it is also possible to carry out the sputtering process while the coupling element row 1 is being fed horizontally.

Specifically, a container 31 which houses the coupling element row 1 is positioned on the upstream side, and the etching chamber 25 and the sputtering chamber 4 are provided in this order in the horizontal direction. A container 32 is provided on the downstream side to house the coupling element row 1 coming from the sputtering process. A plurality of feed rollers 33 is arranged in line from the upstream side extending downstream. The coupling element row 1 is fed so that its pitch is not distorted while being supported from the downside by the feed rollers 33, and is subjected to the etching process, followed by the sputtering process. All the feed rollers 33 are preferably linked to the drive source and rotated in concert. The etching chamber 25 and the sputtering chamber 4 in this embodiment are the same as these described for the previous embodiments.

Figure 11:
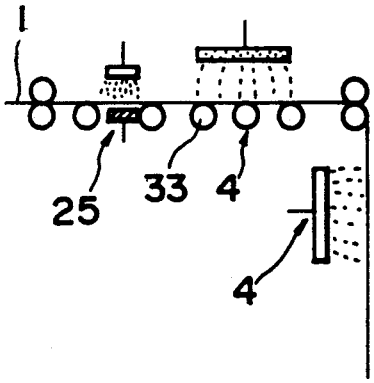

FIG. 11 shows a device suitable for the implementation of the fourth embodiment of the present invention. The coupling element row 1 is fed in the horizontal direction so that its pitch is not distorted while being supported from the downside by the feed rollers 33, and is subjected to the etching process. One surface of the coupling element row 1 is subjected to sputtering, then the coupling element row 1 is fed vertically downward so that its pitch is not distorted, and the other surface of the coupling element row 1 is subjected to the sputtering process.

Figure 12:
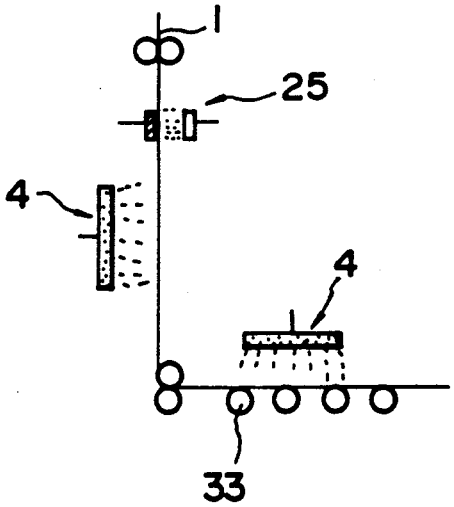

FIG. 12 shows a device suitable for the implementation of the fifth embodiment of the present invention. The coupling element row 1 is fed vertically downward so that its pitch is not distorted, and is subjected to the etching process. One surface of the coupling element row 1 is subjected to sputtering. Then, the coupling element row 1 is fed in the horizontal direction so that its pitch is not distorted while being supported from the downside by the feed rollers 33, and the other surface of the coupling element row 1 is subjected to the sputtering process.

Figure 13:
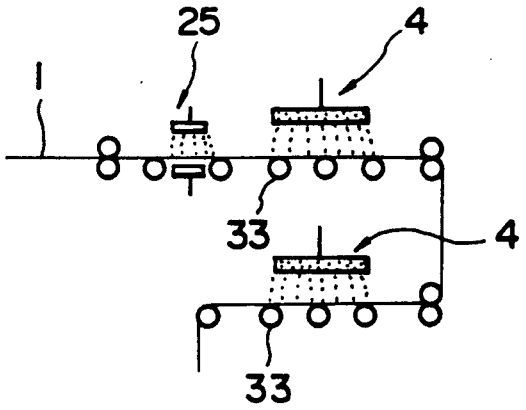

FIG. 13 shows a device suitable for the implementation of the sixth embodiment of the present invention. The coupling element row 1 is fed in the horizontal direction so that its pitch is not distorted while being supported from the downside by the feed rollers 33, and is subjected to the etching process. One surface of the coupling element row 1 is subjected to sputtering, and then the feed direction of the coupling element row 1 is reversed 180°. Thereafter, the coupling element row 1 is fed again in the horizontal direction so that its pitch is not distorted while being supported from the downside by the feed rollers 33, and the other surface of the coupling element row 1 is subjected to the sputtering process.

In all of the fourth, fifth, and sixth embodiments outlined above, the upper surface and the lower surface of the coupling element row 1 are subjected to the sputtering process in sequence.

Figure 14:
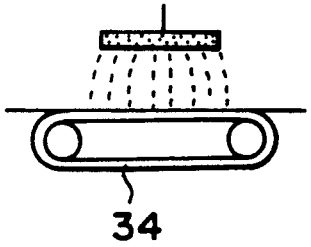
Figure 15:
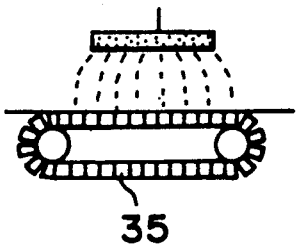

When the coupling element rows 1 described above are fed in the horizontal direction, they are supported from the downside by the feed rollers 33 so that the pitch of these coupling element rows 1 is not distorted. However, as shown in FIG. 14, it is also acceptable to use an endless belt 34 of a specified length extending horizontally in place of the feed rollers 33. Further, as shown in FIG. 15, a caterpillar-shaped belt 35 of a specified length extending horizontally may also be used in place of the feed rollers 33. In all cases, the coupling element row 1 can be fed in the horizontal direction so that its pitch is not distorted while being supported from the downside.

In the third embodiment to the sixth embodiment, both an etching chamber and sputtering chamber are provided. However, if the coupling element row 1 is etched beforehand, the etching chamber can be omitted and only a sputtering chamber provided.

According to the surface treating method of the present invention, a coupling element row made of a synthetic resin for a slide fastener is first etched, and then subjected to sputtering while feeding it so as not to distort its pitch. In such a manner, since fine metallic particles are individually deposited, the deposition of the fine metal particles on the surface of the coupling element row is firmly effected due to an anchoring effect without distorting its pitch.

Accordingly, a slide fastener with the coupling element row obtained by the method as above mentioned, mounted on a support tape, is free from exfoliation of the deposited metal from the action of the slider, and can maintain a good outward appearance for an extended period of time.

Moreover, since the fine metal particles are individually deposited on the etched surface of the coupling element row, the deposited metal particles are not hardened. Therefore, even when the slide fastener on which the coupling element row is mounted is bent or stretched, no exfoliation of the metal particles occurs. If, by some chance, exfoliation of metallic particles were to occur, it would be suppressed to only a localized exfoliation. It is therefore possible to maintain a good product on which not extensive exfoliation occurs.

What is claimed is:

1. A surface treating method for a coupling element row for a slide fastener comprising the steps of:

etching the surface of a continuous coupling element row made of a synthetic resin, and depositing fine metal particles individually on the etched surface of said continuous coupling element row by sputtering while feeding said coupling element row so as not to distort the pitch thereof.

2. The surface treating method as claimed in claim 1, wherein said continuous coupling element row with the etched surface is fed in the vertical direction so as not to distort the pitch thereof.

3. The surface treating method as claimed in claim 1, wherein said continuous coupling element row with the etched surface is fed in the horizontal direction while being supported from the downside so as not to distort the pitch thereof.

4. A coupling element row for a slide fastener comprising a continuous coupling element row of a synthetic resin, said element row having a pitch free of distortions and having an etched surface with fine indentations, and a layer of individual, fine metal particles being deposited on said etched surface.

5. A coupling element row according to claim 4, wherein said individual, fine metal particles are sputtered particles applied while feeding the coupling element row so that there is no distortions in the pitch thereof.

* * * * *